US008656560B2

(12) United States Patent
Liermann

(10) Patent No.: US 8,656,560 B2
(45) Date of Patent: Feb. 25, 2014

(54) ARRANGEMENT OF TWO COMPONENTS

(75) Inventor: Nicolas Liermann, Rheda-Wiedenbrueck (DE)

(73) Assignee: Simonswerk, Gesellschaft mit beschraenkter Haftung, Rheda-Wiedenbrueck (DE)

( * ) Notice: Subject to any disclaimer, the term of this patent is extended or adjusted under 35 U.S.C. 154(b) by 0 days.

(21) Appl. No.: 13/438,135

(22) Filed: Apr. 3, 2012

(65) Prior Publication Data

US 2012/0266412 A1 Oct. 25, 2012

(30) Foreign Application Priority Data

Apr. 21, 2011 (DE) ..... 10 2011 002 216

(51) Int. Cl.
*E05D 5/02* (2006.01)
*E05D 7/04* (2006.01)
*E05D 3/00* (2006.01)

(52) U.S. Cl.
USPC ..... 16/387; 16/382; 16/236

(58) Field of Classification Search
USPC ..... 16/271, 272, 270, 236, 237, 238, 240, 16/245, 246; 164/131, 344, 347, 137, 339
See application file for complete search history.

(56) References Cited

U.S. PATENT DOCUMENTS 1,505,029 A * 8/1924 Kellerman ..... 16/270
3,201,821 A * 8/1965 Ruckstuhl ..... 16/366
3,300,809 A * 1/1967 Neerman et al. ..... 16/270
3,524,216 A * 8/1970 Fernandez et al. ..... 16/249
4,928,350 A * 5/1990 Morgan ..... 16/297
5,259,091 A * 11/1993 Mordick ..... 16/262
5,611,112 A * 3/1997 Rock et al. ..... 16/237
5,901,415 A * 5/1999 Morrison et al. ..... 16/371
5,915,441 A * 6/1999 Schlack ..... 16/371
RE37,436 E * 11/2001 Santarossa ..... 427/356
6,434,791 B1 * 8/2002 Chung ..... 16/387
6,588,490 B2 * 7/2003 Rommel et al. ..... 164/369
6,766,561 B1 * 7/2004 Cheng ..... 16/235
6,769,474 B2 * 8/2004 Engels et al. ..... 164/312
6,772,748 B2 * 8/2004 Cleary ..... 125/1
6,808,005 B2 * 10/2004 Bloch et al. ..... 164/131
6,810,563 B1 * 11/2004 Domenig et al. ..... 16/387
6,826,803 B2 * 12/2004 Twomey ..... 16/387
7,007,346 B2 * 3/2006 Hoffman ..... 16/367
7,036,187 B2 * 5/2006 Rude ..... 16/342
7,350,272 B2 * 4/2008 Fries ..... 16/246
7,594,300 B2 * 9/2009 Nallamottu ..... 16/236
7,614,116 B2 * 11/2009 Chen et al. ..... 16/238

(Continued)

FOREIGN PATENT DOCUMENTS

DE 202005018102 U1 * 3/2006
DE 202006004198 U1 * 7/2006

(Continued)

*Primary Examiner* — Victor Batson
*Assistant Examiner* — Jason W San
(74) *Attorney, Agent, or Firm* — Michael J. Striker

(57) ABSTRACT

An arrangement of a first component and a second component includes that the first component is manufactured by die casting to include a recess in which a section of the second component is adjustably guided. A side wall of the recess is provided with a mold release bevel. The side wall includes a region adjacent to the mold release bevel having a straight surface opposite the mold release bevel. The section of the second component is guided between the region and a straight mating surface.

12 Claims, 8 Drawing Sheets

(56) References Cited

U.S. PATENT DOCUMENTS

Figure 1:
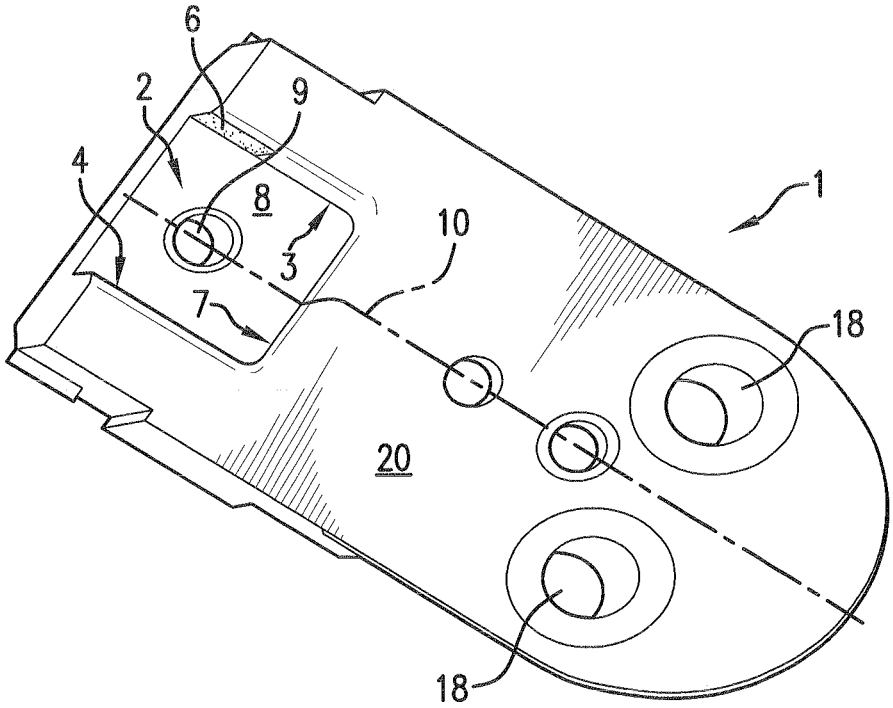

| | | | | |
|---|---|---|---|---|
| 8,196,265 | B2 * | 6/2012 | Neukoetter et al. | 16/389 |
| 2003/0088943 | A1 * | 5/2003 | Neukotter | 16/366 |
| 2008/0060401 | A1 * | 3/2008 | Ramsauer | 70/370 |
| 2009/0038116 | A1 * | 2/2009 | Hsu et al. | 16/240 |
| 2010/0122431 | A1 * | 5/2010 | Neukoetter et al. | 16/238 |
| 2010/0242227 | A1 * | 9/2010 | Tagtow et al. | 16/237 |
| 2011/0308041 | A1 * | 12/2011 | Le et al. | 16/248 |
| 2012/0266412 | A1 * | 10/2012 | Liermann | 16/387 |
| 2012/0291222 | A1 * | 11/2012 | Liermann | 16/237 |
| 2012/0291225 | A1 * | 11/2012 | Liermann | 16/364 |

FOREIGN PATENT DOCUMENTS

| | | | | |
|---|---|---|---|---|
| DE | 102008057341 | B3 | * | 12/2009 |
| DE | 102009020626 | B3 | * | 10/2010 |
| EP | 2 186 979 | | | 5/2010 |
| GB | 2069592 | A | * | 8/1981 |
| JP | 2012223821 | A | * | 11/2012 |

* cited by examiner

ARRANGEMENT OF TWO COMPONENTS

CROSS-REFERENCE TO A RELATED APPLICATION

The invention described and claimed hereinbelow is also described in German Patent Application DE 10 2011 002 216.3, filed on Apr. 21, 2011. The German Patent Application, whose subject matter is incorporated by reference herein, provides the basis for a claim of priority of invention under 35 U.S.C. 119(a)-(d).

BACKGROUND OF THE INVENTION

The invention relates to an arrangement of two components, in particular hinge components, wherein at least the first component is produced by die casting and comprises a recess in which at least one section of the second component is adjustably guided, wherein at least one side wall of the recess is provided with a mold release bevel. The invention also relates to a method for manufacturing the first component. The components can be parts of a door hinge that can be adjusted relative to each other in particular.

Die casting is an industrial casting method for the series production and mass production of components. Individual components are produced by metal die casting in the manufacture of door hinges as well. The advantage results that relatively complex shapes can be formed in a single reshaping process.

Document EP 2 186 979 A2 describes a door hinge having a fastening part which comprises a base. An insert is inserted into a recess of the base. The joints of the door hinge are positioned at the insert.

The base of the door hinge is a component that can be produced by die casting. To this end, molten metal is pressed into a mold under high pressure and at a high rate of speed. The mold is designed such that at least one side wall of the recess comprises a slight bevel, which is also referred to as a mold release bevel. The mold release bevel is a deviation from the vertical in model and mold making. It makes it possible to lift the finished model out of the mold without damage. Clamping or scuffing of the material is thereby prevented. A mold release bevel can be provided on all sides or on only one side of a model that extends at a right angle to the parting. For small parts, the mold release bevel is typically 2%.

For arrangements of the type in question, at least one wall of the recess of the first component is not straight, but rather is beveled. This results in a funnel-type recess, the cross section of which decreases in the insertion direction. When the second component is inserted into the recess, the distance of the inserted part to the side wall becomes shorter and shorter due to the bevel thereof. When the position of the two components is adjusted relative to each other, variable play results, although a fixed seat is not ensured.

SUMMARY OF THE INVENTION

The present invention provides improvements to known prior art systems, at least some of which overcome the above-mentioned shortcomings.

In an embodiment, the invention provides an arrangement of two components, the position of which relative to each other can be adjusted such that consistent guidance is ensured without variable play and while ensuring that the die-cast component can be easily removed from the mold.

In the invention, a side wall provided with a mold release bevel has a region comprising a straight surface, wherein a section of the second part is guided between the region and a straight mating surface. This region forms a straight guide strip which is integrally formed onto the otherwise beveled side wall. In contrast to the surfaces having the mold release bevel, the region having the straight surface extends parallel to the guidance direction. When the position of the two components relative to each other is adjusted, the distance of the section of the second part to the region having the straight surface remains constant, thereby ensuring that variable play does not occur during adjustment and, therefore, that guidance is precise across the entire adjustment range.

To manufacture the first component, liquid molten metal is pressed into a diecasting mold. The diecasting mold is designed such that at least one side wall of the recess is provided with a mold release bevel. According to the invention, a region having a straight surface is integrally formed onto this side wall. In principle, it is also possible to integrally form this region in a separate working step after the casting process. Preferably, this region is integrally formed during casting, however, in that it is formed as a negative in the diecasting mold.

Due to the mold release bevel of the side wall, the first component can be easily removed from the diecasting mold. The side wall has a region having a straight surface as well as a region having a beveled surface. The straight region ensures precise guidance, and the beveled region ensures easy removal from the mold. Due to the mold release bevel, the material is not clamped or scuffed, surprisingly not even at a region having the straight surface if it not selected too large. As viewed in the guidance direction, the straight region is disposed next to the mold release bevel of the side wall. The height of the straight region is selected such that the section of the second component is guided across the entire adjustment range of the two components from the straight region.

To ensure that release from the mold is still easily possible, the straight region is less than 50%, in particular less than 30% of the total surface of the side wall. Preferably, the straight region is integrally formed onto the side wall as an elongate guide strip. The remainder of the side wall is beveled.

The section of the second component that is inserted into the recess preferably has smooth, straight surfaces, which extend parallel to the guidance direction. It is thereby ensured that the second component can glide in a straight line parallel to the guidance direction. The straight region of the side wall of the first component and the straight surfaces of the second component are always parallel to each other in every position of the two components during adjustment.

It proves particularly favorable for the straight region of the side wall to protrude relative to the rest of the side wall. It is preferably a projection with offset. The region is formed by a material accumulation, which protrudes within the recess.

Alternatively, play-free guidance takes place by way of a slight interference fit. The second component is inserted with interference into the recess of the first component. This means that the second component has a greater width or larger diameter than does the recess at that point. In an interference fit, the second component can be initially inserted into the recess with a certain amount of play before an adjustment means in the form of a spindle, screw or the like engages. By actuating the adjustment means, the second component can be drawn further into the recess. When the second component having a slight oversize fit then comes in contact with the straight region, the higher frictional forces that occur during adjustment can be overcome with the aid of the adjusting element. Displacement is thereby made possible that cannot be carried out by way of simple manual actuation.

Excessive clamping can be prevented, however, in that the straight region extends across only a portion of the corresponding mating surface or the side wall. To achieve the mode of operation described, the straight region advantageously starts at a certain distance from the upper edge of the recess, wherein the adjusting element is then selected such that it brings about a connection between the first component and the second component before the second component comes in contact with the straight region of the side wall of the first component.

For practical reasons or due to production tolerances, it is always possible, of course, to provide slight undersizing or even slight undersizing, which permits movement to take place without clamping. This yields the advantage that the mold release bevel does not result in additional inaccuracies or additional play.

The recess can have different shapes. For example, the die-cast component also can have a cylindrical recess. It proves particularly advantageous, however, for the first component to be provided with a cuboid recess.

The recess can be a closed recess, which has four side walls in the case of a cuboid design. Alternatively, the recess can be U-shaped and therefore comprises only the base and two side walls, which are opposite each other.

It proves particularly favorable to provide a recess, which is open at one side, and therefore comprises a base and two side walls opposite each other, which are connected by way of a third side wall.

The base of the recess is preferably flat, and therefore the region having the straight surface is oriented perpendicularly to the base.

In another embodiment, at least one side wall of the recess has a region having a straight surface. The straight mating surface is preferably formed by an opposite side wall. The entire opposite side wall can be formed as a straight surface, that is, without a mold release bevel. Alternatively, the opposite wall also is equipped with a mold release bevel. In this case, the opposite wall also has a region having a straight surface. The opposite straight regions ensure guidance without variable play. It proves particularly favorable for the regions to be disposed with mirror symmetry relative to each other and to be the same size.

In another embodiment, the two components are detachably interconnected by way of a fastening or adjusting element. To this end, a bore is formed in the base of the recess, into which the fastening or adjusting element can be screwed. A screw or an adjusting spindle is preferably used as the adjusting element. The position of the two components relative to each other can be changed using the adjusting element.

In another embodiment, the arrangement is used in a door hinge. The arrangement can form the fastening part of a door hinge. The door hinge is affixed at the door leaf or the door frame by way of this fastening part. In the fastening part, one of the components forms the base and the other component forms the insert. Using an adjusting element, the insert can be adjusted along the insertion direction, thereby enabling the position of the base and the insert to be adjusted relative to each other.

BRIEF DESCRIPTION OF THE DRAWING FIGURES

Figure 2:
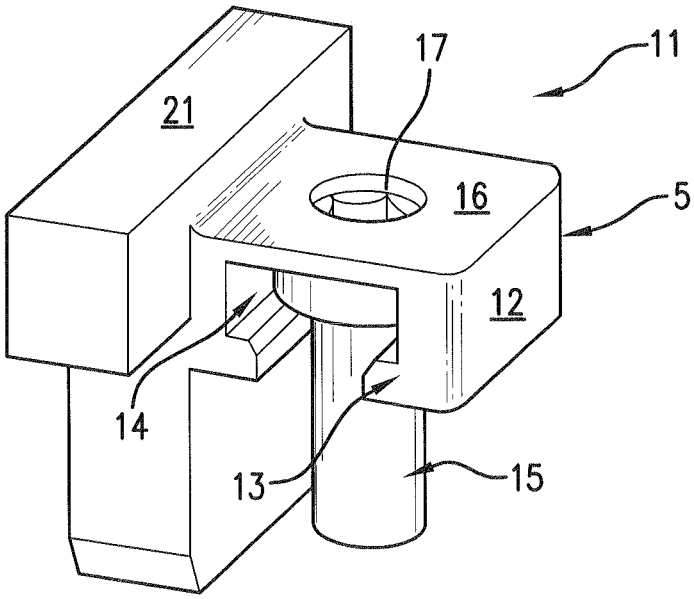
Figure 3A:
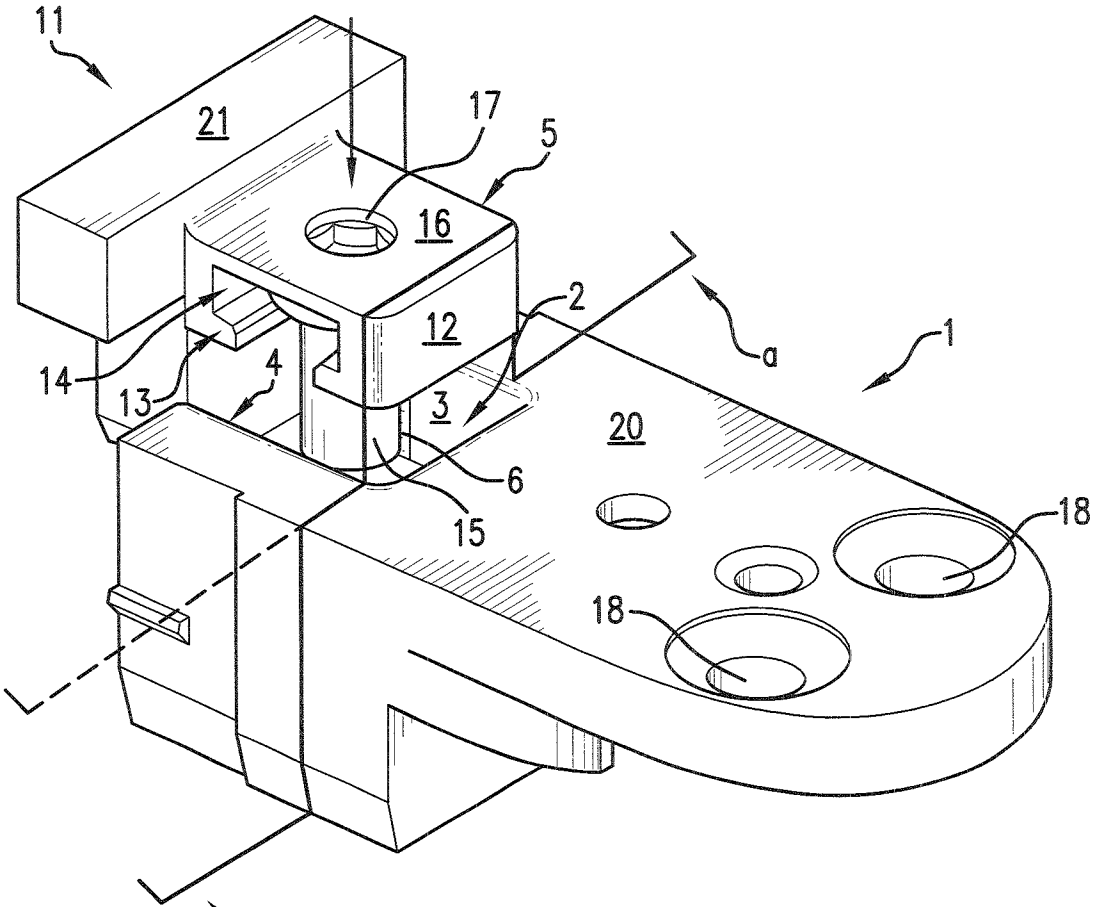
Figure 3B:
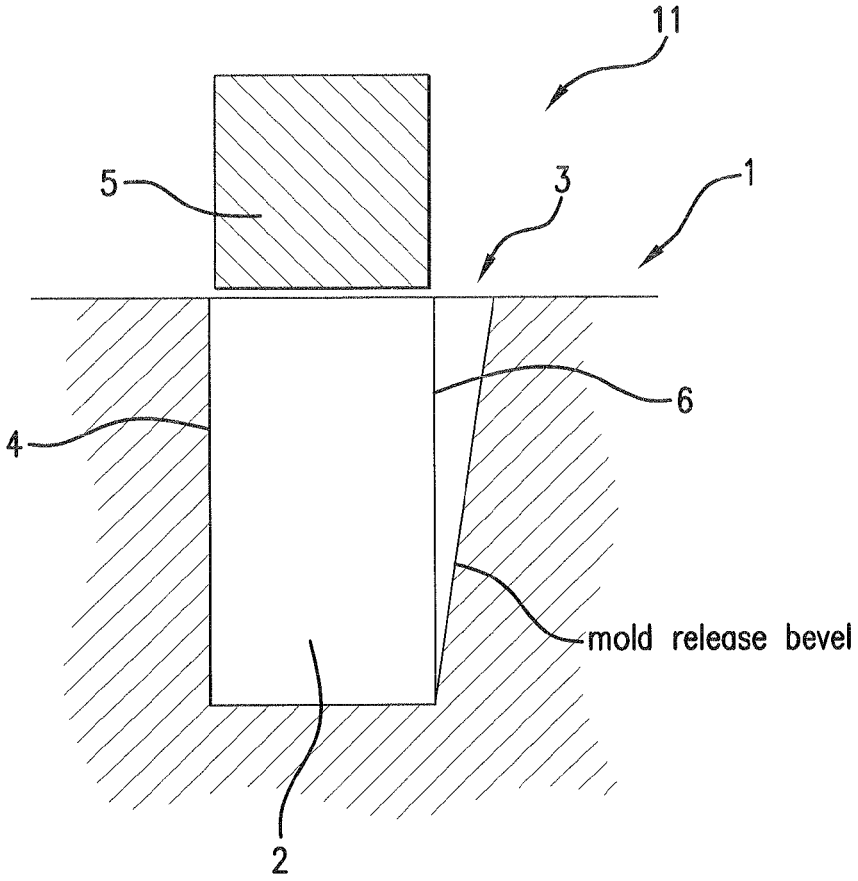
Figure 3C:
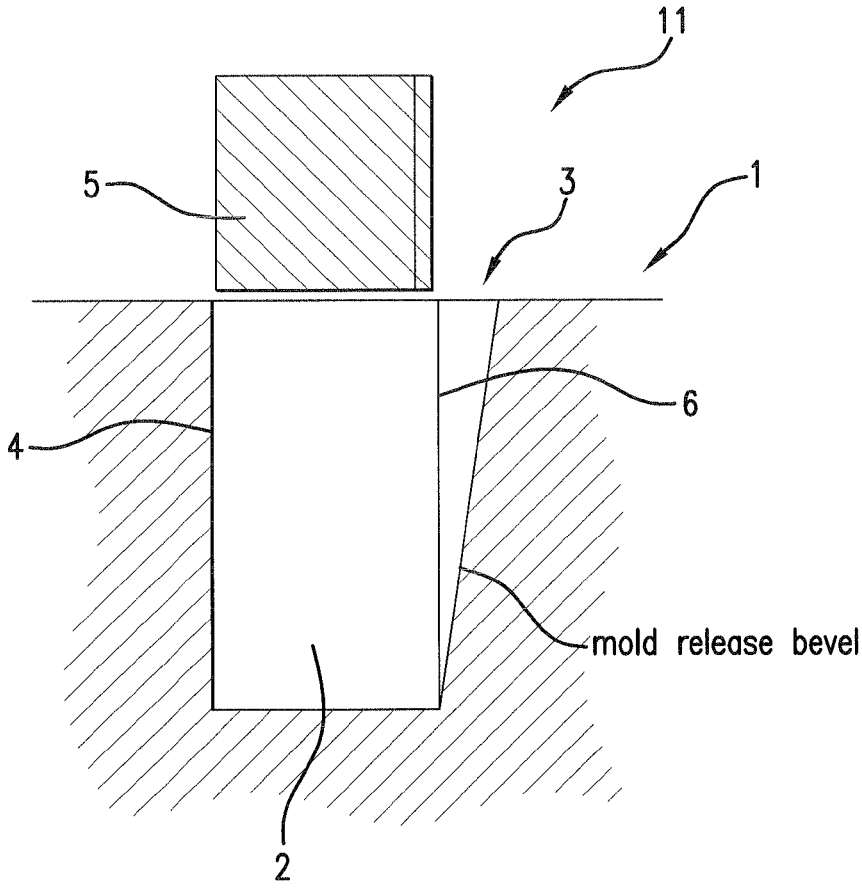
Figure 4:
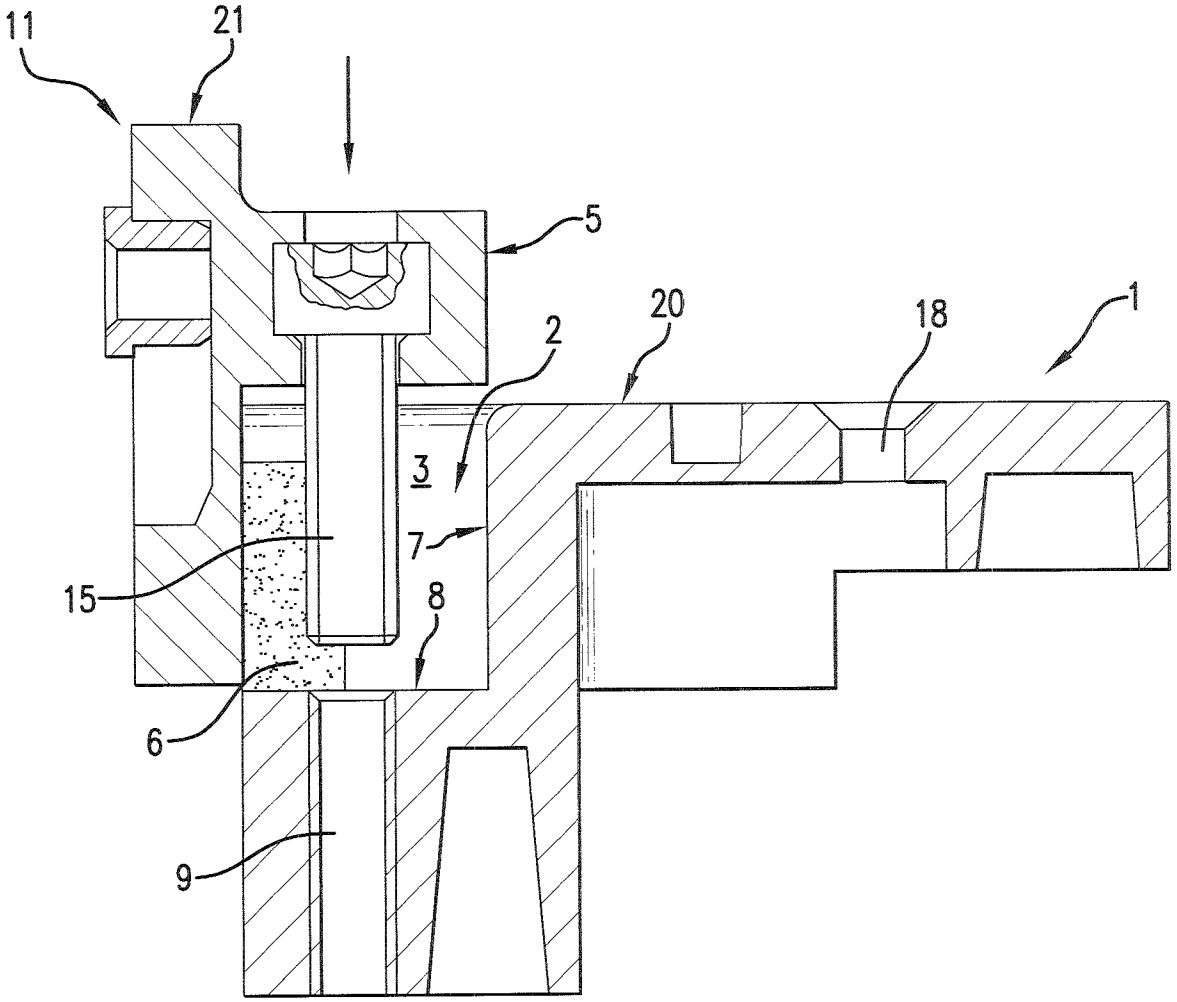
Figure 5:
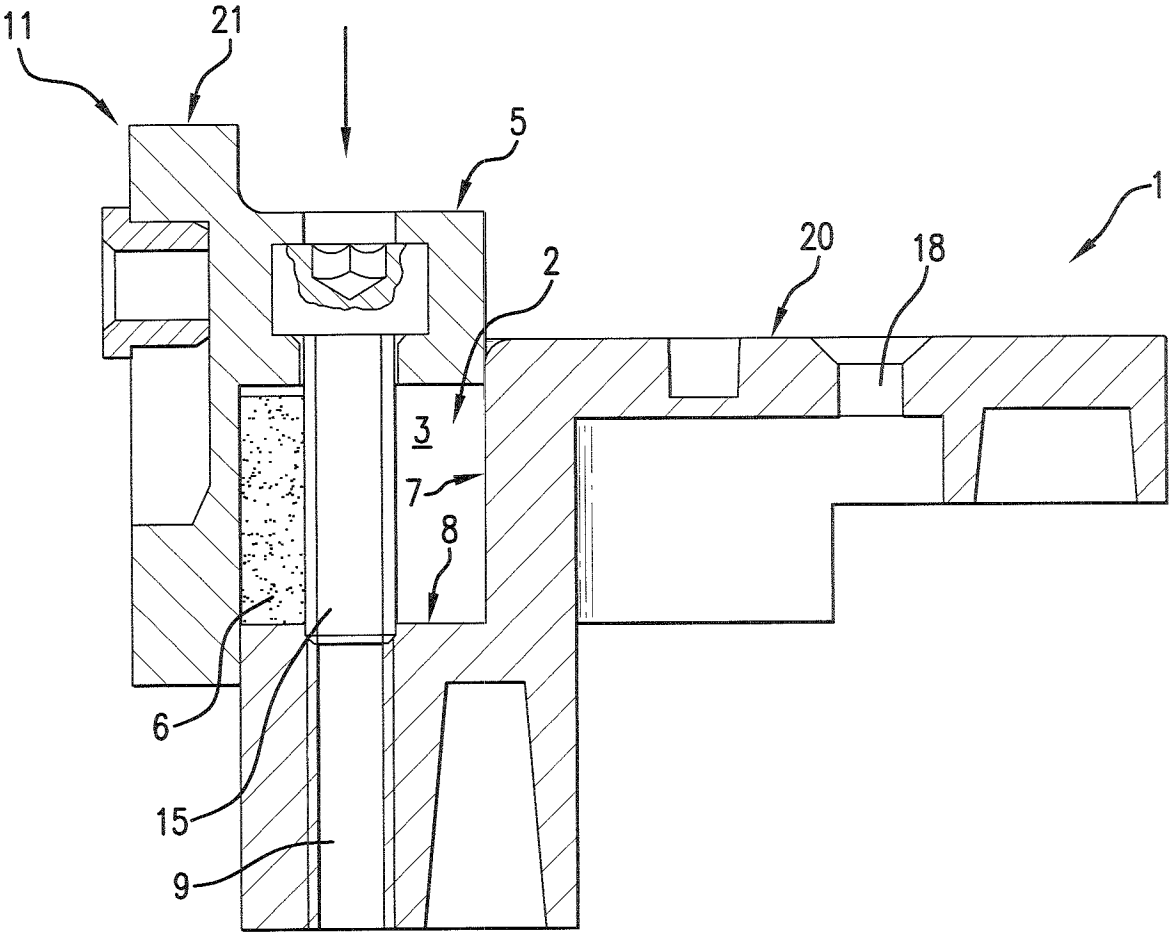
Figure 6:
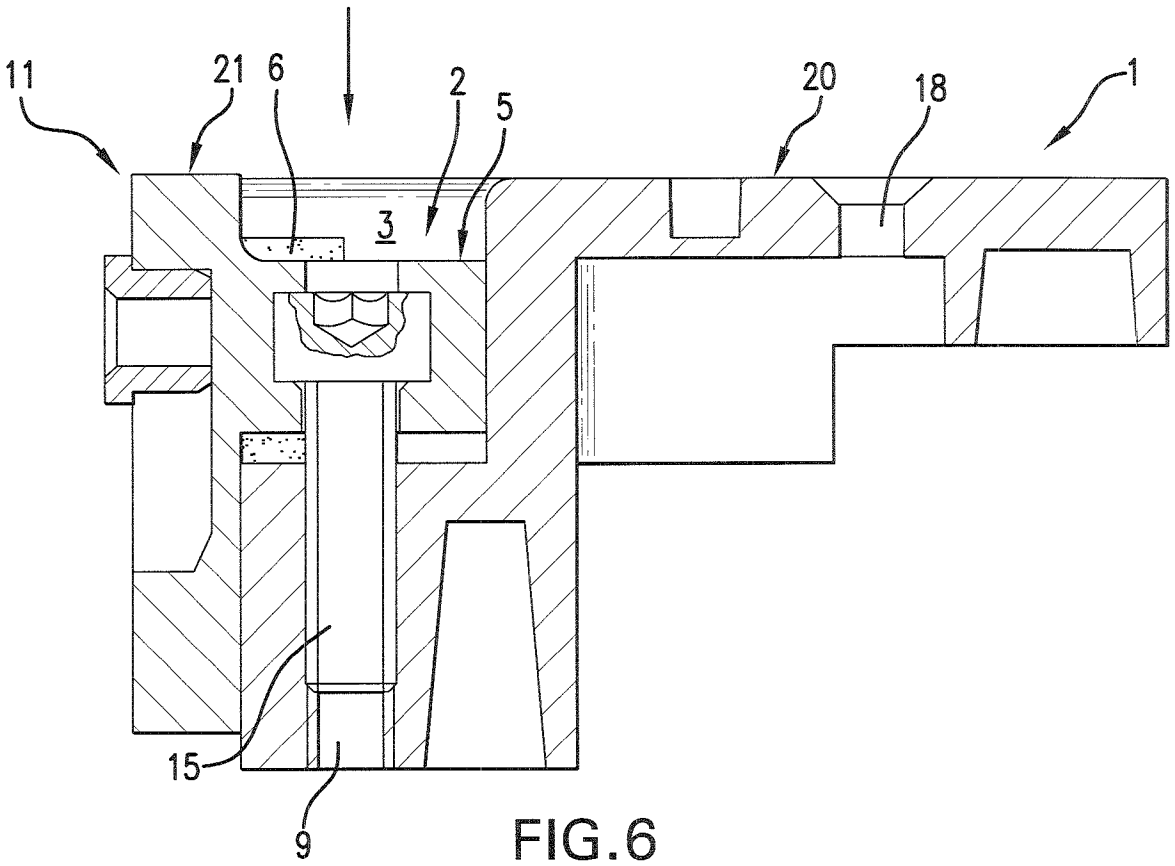
Figure 7:
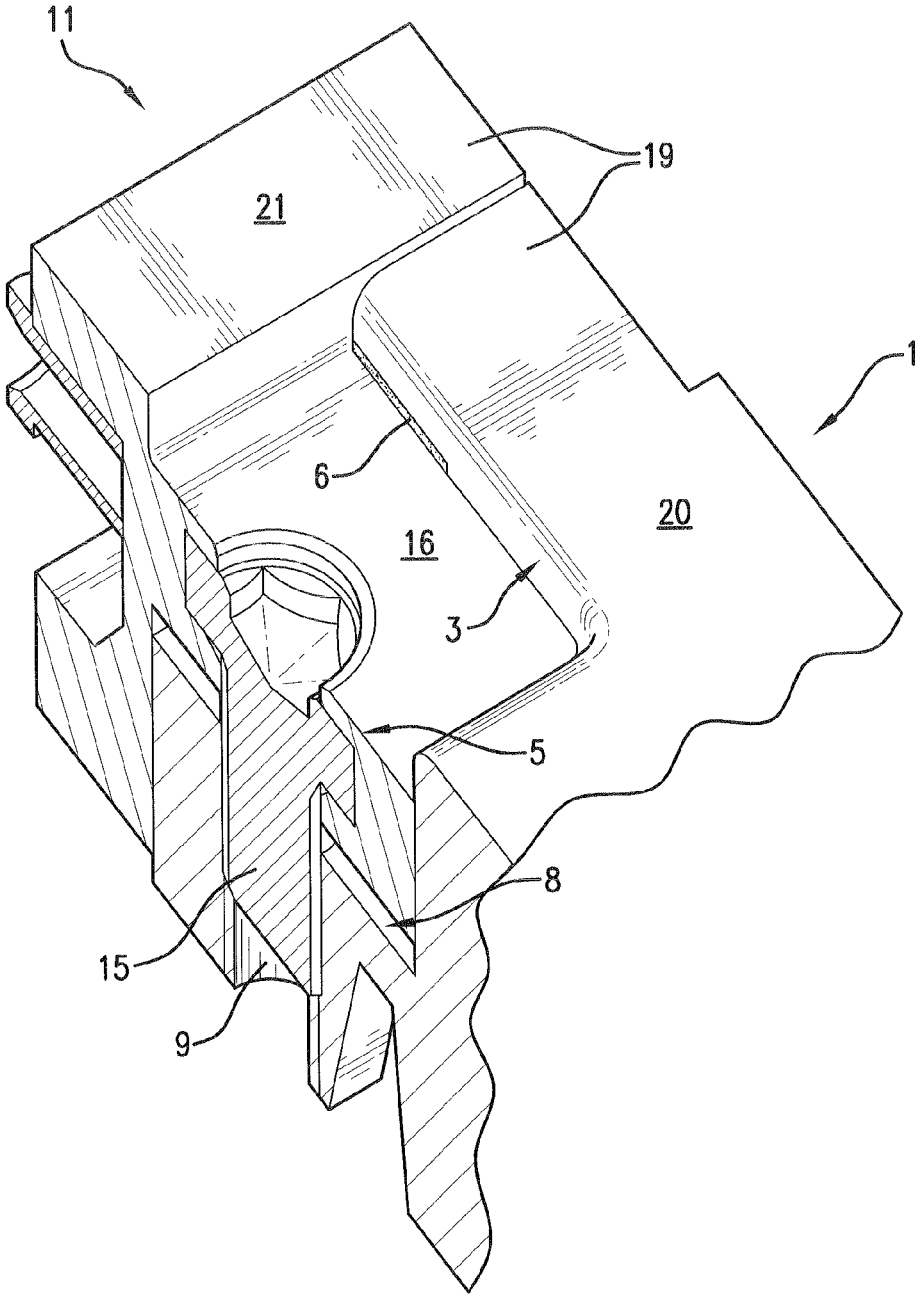

Further features and advantages of the invention will become apparent from the description of an example embodiment with reference to drawings, and from the drawings themselves. Shown are:

FIG. 1 a perspective depiction of the first component of the arrangement;

FIG. 2 a perspective depiction of the second component of the arrangement;

FIG. 3A a perspective depiction of the joining of the two components;

FIG. 3B an enlarged cross-sectional view taking along the lines a-a in FIG. 3A;

FIG. 3C an enlarged cross-sectional view taking along the lines a-a shown in FIG. 3A that highlights an embodiment with play-free guidance;

FIG. 4 a longitudinal view in a position in which an adjusting element does not yet engage in an assigned bore;

FIG. 5 a longitudinal view in a position in which the adjusting element engages in the bore;

FIG. 6 a longitudinal view in a position in which the second component touches a straight region of the first component; and FIG. 7 a perspective depiction in which the second component has been completely inserted into the first component.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

FIG. 1 shows a perspective depiction of a first component 1. The component 1 is produced by die casting and comprises a recess 2. To enable easy removal from the casting mold, at least one side wall 3 is provided with a mold release bevel. At the bevel of the side wall 3, straight guidance is not possible when a section 5 of a second component 11 is inserted into the recess 2. The second component 11 is depicted in FIG. 2. "Play" between the section 5 and the bevel varies depending on the insertion depth.

According to the invention, the side wall 3 therefore has a region 6 having a straight surface. The section 5 is guided between the straight region 6 and a straight mating surface 4. The straight region 6 is integrally formed onto the side wall 3 as a material accumulation. The straight mating surface 4 is formed by the opposite side wall. The distance of the straight region 6 and the mating surface 4 remains constant along the entire insertion depth. The play does not change when the position of the two components 1, 11 changes. Precise guidance is therefore ensured.

The straight region 6 is integrally formed onto the side wall 3 as a material accumulation. The straight region 6 protrudes relative to the rest of the side wall 3, which is provided with the mold release bevel. Upon insertion of the section 5, the distance of the inserted section 5 from the side wall 3 is the least within this straight region 6.

If the opposite side wall likewise comprises a mold release bevel, this side wall can also be provided with a region that has a straight surface. In this case, this region then forms the straight mating surface 4. Preferably, the straight regions are disposed with mirror symmetry relative to each other with respect to a longitudinal axis 10. It also proves advantageous for the opposite regions to be the same size.

The two opposite side walls of the recess 2 are connected by way of a side wall 7. A lateral opening of the recess 2 is disposed opposite the side wall 7. In the side wall 3, the straight region 6 is located next to a beveled region of the side wall 3 as viewed in the guidance direction. The straight region 6 is preferably disposed in the direction of the lateral opening, while the beveled region lies in the direction of the side wall 7.

The straight region 6 of the side wall 3 should only be wide enough to ensure precise guidance. The narrower the straight region 6 is, the easier it is to remove the component 1 from the mold.

The height of the straight region 6 depends on the adjusting range within which the two components 1, 11 should be adjusted relative to each other. The section 5 of the second component 11 should be guided by the straight region 6 within the entire adjusting range.

The side walls 3, 4, 7, in combination with the base 8, form the recess 2 of the first component 1. The base 8 is provided with a bore 9. The bore 9 is disposed in the center on the longitudinal axis 10.

The straight region 6 is preferably less than 50%, in particular less than 30%, of the total surface of the side wall 3. It is thereby ensured that the component 1 can be removed from the mold without clamping or scuffing the material.

FIG. 2 shows the second component 11. Component 11 comprises the protruding section 5, which is guided on the first component 1. The section 5 is cuboid. It comprises three straight lateral surfaces, of which two lateral surfaces 12, 13 are shown in FIG. 2. A recess 14 is formed at the lateral surface 13, in which an adjusting element 15 is placed. In the example shown, a simple screw is used as the adjusting element 15. An opening 17 is formed at the surface 16 of the section 5, by way of which the adjusting element 15 can be rotated, using a hollow hexagon wrench, for example.

In FIG. 3A, the two components 1, 11 are joined in the direction of the arrow shown. The section 5 of the second component 11 is guided in the recess 2 of the first component 1. To ensure straight, precise guidance without variable play despite the side wall 3, which is provided with a mold release bevel, the side wall 3 has a region 6 having a straight surface. The straight lateral surface 13 of the section 5 is guided by the straight side wall 4 as the mating surface of the recess 2. The straight side surface of the section 5 that is opposite the side surface 13 is guided by the straight, integrally formed region 6 of the side wall 3.

In the example shown, the two components 1, 11 form the fastening part of a door hinge. A milled area is formed in the narrow side of a door leaf, into which the fastening part is inserted and is fastened by way of screws in bores 18.

The component 1, which is produced by die casting, forms the base of the fastening part of the door hinge. The second component 11 is an insert, which is placed into the base. The joint of the door hinge is supported on the second component 11. The insert is disposed in the base such that it can be displaced in the direction of the arrow shown. The adjusting element 15, which connects the insert to the base, is used to adjust the insert.

FIGS. 4 to 6 show different positions in the joining of the two components 1, 11.

FIG. 3B presents an enlarged cross-section view of the joined first and second components 1, 11, from a planar perspective at line a-a of FIG. 3A. Therein, a width of section 5 of second component 11 is less than the width of the first component 1. The mold release bevel is shown adjacent straight region 6, which straight region 6 opposes the straight mating surface 4. FIG. 3C presents an presents an enlarged cross-section view of the joined first and second components 1, 11, from a planar perspective at line a-a of FIG. 3B, where a width of section 5 of second component 11 is slightly greater width than that of the first component 1, to effect play-free guidance by way of a slight interference fit.

In FIG. 4, the adjusting element 15 extends into the recess 2 of the first component 1 without engaging in the bore 9. The lateral surface of the section 5 of the second component 11 is not yet in contact with the straight region 6 of the side wall 3.

In the position depicted in FIG. 5, the screw 15, as the adjusting means, engages in the bore 9. In this position, the lateral surface of the cuboid section 5 does not yet touch the straight region 6 of the side wall 3.

FIG. 6 shows a position in which the section 5 is guided between the straight region 6 of the side wall 3 and the opposite side wall as the mating surface 4.

FIG. 7 shows the two components 1, 11 in the joined position. The position of the two components 1, 11 relative to each other can be changed using the adjusting element 15. The front surface 19 of the arrangement is formed by the front surface 20 of the first component 1 and the front surface 21 of the second component 11. The section 5 is guided between the straight region 6 and the straight mating surface 4 orthogonally to the front surface 19 of the arrangement.

By comparing FIGS. 4 to 5, it is clear that the protruding section 5 of the second component 11 can have a certain oversize relative to the recess 2 of the first component 1, that is, relative to the region 6 having the straight surface. The recess 2 is then advantageously designed such that the section 5 of the second component can initially be inserted into the recess 2 with a certain amount of play in the adjusting direction (FIG. 4).

The adjusting element 15 is designed such that it engages into the bore 9, which is equipped with a thread, before the section 5 rests against the straight region 6 (FIG. 5). By rotating the adjusting element 15, the section 5 is pulled further into the recess 2 and comes in contact with the straight region 6. Since large forces can be applied using the adjusting element 15, a certain amount of clamping also may be overcome due to an oversize. It is therefore possible to perform adjustment without play, with a stronger application of force, which is not possible manually.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. An arrangement including a first component (1) and a second component (11), wherein the first component (1) is manufactured by die casting and comprises a recess (2) in which at least one section (5) of the second component (11) is adjustably guided, wherein the recess (2) includes a side wall (3) that extends from a lateral recess opening in parallel with an opposing straight mating surface (4), where the side wall (3) and the straight mating surface (4) are connected by a lateral side wall (7) disposed opposite the lateral recess opening, wherein the side wall (3) of the recess (2) is provided with a mold release bevel and a straight region (6) adjacent to the mold release bevel and opposite the straight mating surface, and wherein the section (5) of the second component (11) is guided between the region (6) and the straight mating surface (4).

2. The arrangement according to claim 1, wherein an amount of play or clearance between the section (5) and the straight region (6) of the side wall (3) remains constant when adjusting a position of the first component (1) and the second component (11) relative to one another.

3. The arrangement according to claim 1, wherein the straight region (6) adjacent the mold release bevel of the side wall (3) extends into the recess (2).

4. The arrangement according to claim 1, wherein the straight region (6) is less than 50% of the total area of the side wall (3).

5. The arrangement according to claim 1, wherein the straight mating surface (4) is provided with a mold release bevel in addition to the straight mating surface.

6. The arrangement according to claim 5, wherein the straight region (6) of the side wall (3) and the straight mating surface (4) are disposed with mirror symmetry with respect to one another.

7. The arrangement according to claim 1, wherein a base (8) of the recess (2) comprises a bore hole (9) into which an adjustment element (15) is screwed to adjust a position of the first component (1) and the second component (11) relative to one another.

8. The arrangement according to claim 1, wherein the first component (1) includes a front surface (20) and the second component (11) includes a front surface (21) is adjustable relative to the first component (1) when section (5) is guided along a direction orthogonal to a front surface (19) of the arrangement that is formed by front surface (20) and front surface (21).

9. The arrangement according to claim 1, wherein the first component (1) forms a main body and the second component (11) forms an insert of a fastening part of a door hinge.

10. The arrangement according to claim 1, wherein the first component (1) and the second component (11) are hinge components.

11. The arrangement according to claim 4, wherein the straight region (6) is less than 30% of the total area of the side wall (3).

12. The arrangement according to claim 7, wherein the section (5) is configured with a width that is slightly larger than a diameter of the recess so that the second component is drawn further into the recess (2) using the adjustment element (15).

* * * * *